US011130651B2

(12) United States Patent
Brunner

(10) Patent No.: US 11,130,651 B2
(45) Date of Patent: Sep. 28, 2021

(54) THREAD GUIDING DEVICE

(71) Applicant: HEBERLEIN AG, Wattwil (CH)

(72) Inventor: Andreas Brunner, Wuppenau (CH)

(73) Assignee: HEBERLEIN AG, Wattwil (CH)

( * ) Notice: Subject to any disclaimer, the term of this patent is extended or adjusted under 35 U.S.C. 154(b) by 8 days.

(21) Appl. No.: 16/754,437

(22) PCT Filed: Oct. 16, 2017

(86) PCT No.: PCT/EP2017/076346
§ 371 (c)(1),
(2) Date: Apr. 8, 2020

(87) PCT Pub. No.: WO2019/076431
PCT Pub. Date: Apr. 25, 2019

(65) Prior Publication Data

US 2021/0198079 A1 Jul. 1, 2021

(51) Int. Cl.

| | |
|---|---|
| ***B65H 57/04*** | (2006.01) |
| ***B65H 57/26*** | (2006.01) |
| ***B65H 57/16*** | (2006.01) |

(52) U.S. Cl.
CPC ..... *B65H 57/04* (2013.01); *B65H 57/16* (2013.01); *B65H 57/26* (2013.01); *B65H 2701/31* (2013.01)

(58) Field of Classification Search
CPC ..... B65H 57/04; B65H 57/16; B65H 57/26; D02H 13/16–20
See application file for complete search history.

(56) References Cited

U.S. PATENT DOCUMENTS

| | | | |
|---|---|---|---|
| 3,734,374 | A | 5/1973 | Perry |
| 2009/0211219 | A1 | 8/2009 | Buchmüller |

FOREIGN PATENT DOCUMENTS

| | | | |
|---|---|---|---|
| AT | 171 045 | | 4/1952 |
| DE | 21 24 486 | | 12/1972 |
| DE | 22 45 215 | | 8/1973 |
| DE | 41 15 368 | A1 | 11/1992 |
| DE | 199 24 736 | A1 | 7/2000 |
| DE | 200 10 219 | U1 | 9/2000 |
| DE | 10 2014 007 454 | A1 | 12/2000 |
| DE | 10 2008 008 516 | A1 | 8/2008 |
| DE | 10 2014 015 768 | A1 | 4/2015 |
| DE | 10 2014 117 454 | A1 | 6/2016 |
| EP | 2 065 495 | A2 | 6/2009 |
| EP | 2 151 409 | A1 | 2/2010 |
| GB | 269 717 | | 4/1927 |
| JP | H06-108303 | A | 1/1994 |
| JP | 2007-265748 | A | 10/2007 |
| WO | 2006/002562 | A1 | 1/2006 |

OTHER PUBLICATIONS

International Search Report Corresponding to PCT/EP2017/076346 dated Nov. 23, 2017.
Written Opinion Corresponding to PCT/EP2017/076346 dated Nov. 23, 2017.

*Primary Examiner* — William E Dondero
(74) *Attorney, Agent, or Firm* — Finch & Maloney, PLLC; Michael J. Bujold; Jay S. Franklin

(57) ABSTRACT

A thread guiding device (100) for guiding threads. The thread guiding device (100) comprises a main element (1), at least one cover element (2) and at least one thread guide (3). The at least one thread guide (3) is, or can be, arranged in a recess (11) of the main element (1). The thread guide (3) is, or can be, removably secured to the main element (3) by the cover element (2).

20 Claims, 4 Drawing Sheets

THREAD GUIDING DEVICE

The present invention relates to a thread guiding device for the guidance of threads.

Thread guiding devices are needed in particular in textile production in the manufacture or treatment of threads for the appropriate textile production. For instance, thread guiding devices are arranged upstream or downstream of a yarn processing nozzle, such as, for instance, a texturing nozzle.

An apparatus for treating filament yarn, as well as knotted, migrated and false twisted yarn, has become known, for instance, from WO 2006/002562 A1. This apparatus has a yarn treating nozzle. Before the nozzle in the direction of running of the thread is arranged a thread guiding device. After the nozzle, likewise in the direction of running of the thread, is arranged a second thread guiding device. The thread guide is configured as a one-piece ceramic element. The thread guide is designed to guide a plurality of threads in parallel.

Depending on the utilization or loading of the apparatus from WO 2006/002562, the thread guide is, however, unevenly stressed, and hence, equally, unevenly worn. Moreover, the thread guiding device must be fully exchanged if one of the plurality of parallelly arranged thread guides is damaged.

The object of the invention is therefore to remedy drawbacks of the prior art. In particular, it is intended to provide a thread guide which is simple to manufacture, inexpensive to operate and easy to maintain.

This object is achieved by the apparatuses defined in the independent patent claims. Further advantageous embodiments emerge from the dependent patent claims.

A thread guiding device according to the invention for the guidance of threads comprises a base element and at least one cover element and at least one thread guide. The at least one thread guide is arranged in a recess of the base element. The at least one thread guide is held with the cover element detachably on the base element. The invention is explained by way of example on the basis of a thread guide for threads. The term "thread" is understood to mean in the present document any type of yarns, filaments or filament bundles.

The term "held" also comprises an arrangement in which the thread guide is held loosely and is secured only against loss. Equally, "held" is understood to mean a firm holding, in which the thread guide is fixed, for instance, under pretensioning.

The thread guide of the thread guiding device can hence be easily exchanged. For this, the cover element has merely to be removed or opened.

The thread guide has preferably, transversely to the intended direction of movement of the thread, an opening for the feed-in of the thread.

By way of example, in the simplest form the thread guide is configured as a slotted eyelet. That is to say, the thread guide has, transversely to the axis of the direction of movement of the thread, no closed contour.

This enables a simple feeding of the thread into the thread guide.

The recess in the base element can have, transversely to the intended direction of movement of the thread, an opening for the sliding-in of the thread guide. As a result, a simple insertion and removal of the thread guide into the thread guiding device, in particular into the base element, is enabled.

The base element can have two or more recesses. Each recess is here preferably assigned a thread guide. As a result, a parallel guidance of a plurality of threads is enabled. Since each thread is assigned a separate thread guide, which is exchangeable, the wearing or damaging of an individual thread guide of the thread guiding device can be compensated independently of the other thread guides. That is to say, an exchange of each individual thread guide is possible without the entire thread guiding device having to be exchanged. It is also conceivable, however, to combine a plurality of thread guides into groups. By grouping a plurality of thread guides, the manufacturing costs can be lowered and the handling simplified. Typically, thread guides can be combined into groups of four. Other group sizes, such as groups of two, three, or, indeed, larger groups, are conceivable.

The cover element has at least one projection for preventing a movement of the thread guide counter to a slide-in direction. Preferably, the projection can be brought into contact with a surface of the thread guide. This enables a simple design of the cover element for a simple securement of the thread guide against loss.

The cover element of the thread guiding device can have at least one web having a free end. The web is arranged or arrangeable between respectively two adjacent recesses of the base element. This enables one web to be assigned to two thread guides.

Preferably, the projection is configured on the free end of the web. Thus, with one projection, two thread guides can be held in the thread guiding device.

In a preferred embodiment, the web is of resilient configuration. On the one hand, this enables the pretensioned holding of the thread guides in the thread guiding device and, in particular, in the base element. On the other hand, by surmounting of the spring force, the cover element can be deflected, for instance, to the point where an insertion or a removal of the thread guide from the base element is enabled, in particular without removing the cover element.

The removal and fitting of the thread guide into the thread guiding device and, in particular, into the base element is hence facilitated.

The at least one projection in the cover element can be formed by an undercut or a depression, in particular a milled recess. The production of the cover element is hence simplified.

Preferably, the base element has feed-throughs, wherein preferably the cover element and the base element have, at least in relation to the recesses and feed-throughs, a substantially geometrically similar contour.

If the feed-throughs in the base element are of substantially U-shaped configuration, for example, the recesses in the cover element are likewise of substantially U-shaped configuration.

This ensures a high accuracy of fit and prevents parts of the cover element or of the base element from extending into the path in which the thread runs. In particular, the cover element can be configured such that the thread guide elements are protected against shocks. Shocks can occur, for instance, when the threads are fed in with a feed gun. Since the cover element has cutouts which are substantially similar to the cutouts of the thread guide element, the thread guide element is substantially covered and thereby protected.

The cover element can have a common projection for two thread guides. As set out in the present document, this enables two thread guides to be held with only one projection.

The cover element can be screwed or screwable to the base element. A simple exchange and a disassembly of the cover element is hence enabled. Thus, this likewise enables a simple exchanging of the thread guides.

The cover element can be articulately, and in particular pivotably, connected to the base element. For the fixing of the cover element, a quick-release fastener, for instance, can be provided to this effect. As the quick-release fastener, a bayonet coupling or a toggle-type fastener, is, for instance, conceivable.

The articulated joint can be configured as a hinge pin. For instance, the hinge pin can be arranged parallel to the direction of movement of the thread, so that the cover element, when used generically, can be tilted upward transversely to the direction of movement of the thread. A quick-release fastener can here be arranged on the cover element opposite the articulated joint.

It is equally conceivable, however, that the articulated joint is arranged transversely to the direction of movement of the thread, and the cover element can be tilted away from the base element in the direction of movement of the thread. That is to say, the cover element when used generically, can be tilted away in the direction of movement of the thread, and subsequently downward.

This enables a simple handling of the cover element. Equally, it is reliably secured against loss. Additional screws for the fastening of the cover element are not necessary. The risk of a loss of separate parts is hence reliably reduced.

The thread guide can have a cross section for engagement in the base element, which cross section is configured such that the thread guide, when used as intended, encompasses the base element at least partially on both sides. The cross section for the contact with the base element and, in particular, can here be configured to form a substantially right-angled groove-and-cam joint.

For instance, the cross section which is designed to engage with the base element has substantially a U-profile. The U-profile can also, however, be interrupted along the joint. On the entry side and exit side of the thread guide in the direction of movement of the thread can therefore be found individual cams or projections, which can be arranged, for instance, such that they run alternatingly around the thread guide, or else can be arranged uniformly.

This enables a simple insertion and removal of the thread guide into the base element.

The thread guide can be produced from a ceramic material. This increases the working life of the thread guide. According to another preferred embodiment, the base element can be provided with venting cutouts. The outflowing air can thus be led off below the thread guide and causes less disturbance to the thread. With a smoother thread guidance, better air interlacing can be achieved.

The invention is explained by way of example on the basis of the following figures, wherein, in schematic representation:

FIG. 1: shows an exploded drawing of a thread guiding device according to the invention, FIG. 2: shows a first embodiment of a thread guide according to the invention, FIG. 3: shows a second embodiment of a thread guide according to the invention, FIG. 4: shows an enlarged representation of individual thread guides and webs from the thread guiding device from FIG. 1, FIG. 5: shows a top view of a thread guiding arrangement, inclusive of sectional drawings, FIG. 6: shows a schematic top view of the thread guide from FIG. 2, FIG. 7: shows a schematic top view of the thread guide from FIG. 3, FIG. 8: shows an exploded drawing of an alternative embodiment of a thread guiding device according to the invention, FIG. 9: shows an exploded drawing of an alternative variant of a thread guiding device according to the invention, FIGS. 10*a*, 10*b*: show perspective representations of the embodiment of a group of thread guides from FIG. 9.

FIG. 1 shows a thread guiding device 100 in an exploded representation. The thread guiding device 100 has a base element 1 and a cover element 2. When used as intended, the base element 1 and the cover element 2 are connected to each other by screws 13, which engage in screw holes 13'. Screws 14 are provided to fasten the thread guide to a counterpart (not shown) suitable for the fastening of the thread guiding device 100.

In the base element 1 are arranged a plurality of recesses 11, though, for better clarity, respectively only one element is denoted by a reference number. Each recess 11 has an, in the present illustration upwardly directed, opening 12. In each recess 11 is here arranged a thread guide 3. The thread guide 3 is explained in detail below with reference to FIGS. 2*a* and 2*b*.

In FIG. 1 are shown two thread guides 3, which, in a slide-in direction E, are found above the recess 11. Through the movement of the thread guides 3 in the slide-in direction E, the thread guides 3 are insertable into the recess 11. Each thread guide 3 has a contact surface 32 (see FIGS. 2 and 3). The contact surface 32 is bound on both sides by a protruding cam 34 and forms together with the cams 34 a groove 35. This groove 35 has a width between the cams 34 which substantially corresponds to the thickness of the base element 1 (see FIG. 1). That is to say, when the thread guide 3 is slid into the recess 11 of the base element 1, this groove slides along a corresponding structure 16 of the base element 1. The cams 34 arranged on both sides of the contact surface 32 herewith encompass the corresponding structure 16 of the base element 1. Thus, the thread guide is secured against displacement in the direction of movement of the thread F (or counter to this direction).

As soon as all thread guides 3 are inserted in the appropriate recesses 11 through the opening 12, the cover element 2 is connected to the base element 1 in order to provide a functional unit.

The cover element 2 has feed-throughs 24, the contour of which substantially correspond to the contour of the recesses 11 of the base element 1. In a bearing surface 25 of the cover element 2 is provided a milled recess 23. The milled recess 23 is configured such that, on individual webs 22 which are arranged between the feed-throughs 24, projections 21 are formed. The milled recess substantially corresponds to somewhat more than the thickness of the cams arranged on both sides of the contact surface 32 (see FIG. 2*a*).

If the cover element 2 is arranged with its bearing surface 25 on a corresponding bearing surface 15 of the base element 1, the milled recess 23 encompasses with the projections 21 that part of the thread guides 3 (namely of one of the cams 34), which protrudes over the base element 1. Through the screwing of the cover element 2 to the base element 2 with the screws 13, all thread guides 3 are thus secured against loss. Equally, the projections 21 prevent a loss of the thread guides 3 counter to the slide-in direction. Due to the covering of the thread guides 3 with the cover element 2, the thread guide, which is generally produced from ceramic material, is protected against shocks, moreover, and hence against any damage from outside.

FIGS. 2 and 3 respectively show a possible embodiment of a thread guide 3. The thread guide 3 in FIG. 2 is substantially configured as an eyelet, which transversely to the direction of movement of the thread F (in FIGS. 2 and 3 respectively represented as an arrow) has an opening 31. In a top view (see FIG. 6) of the opening 31, it can be seen that the opening 31 is configured obliquely to the direction of movement of the thread. A direct radial removal of the thread from the thread guide 3 is thereby prevented.

The thread guide of FIG. 3 has, for the securement of the thread, an extension 33, which engages in an opening 36 but is not connected thereto. As a result, it is likewise possible to feed a thread into the thread guide and to prevent a radial removal of the thread from the thread guide 3 (see also FIG. 7).

FIG. 4 shows an enlarged representation of a detail from the base element 1 with inserted thread guides 3. The webs 22 of the base element 1 respectively have a projection 21. A projection 21 is in contact with the contact surface 32 (see FIGS. 2 and 3) respectively on the end of an arm of two adjacent thread guides 3. The thread guides 3 are thereby held counter to the slide-in direction E in the recesses 11 of the base element 1.

Figure 8:
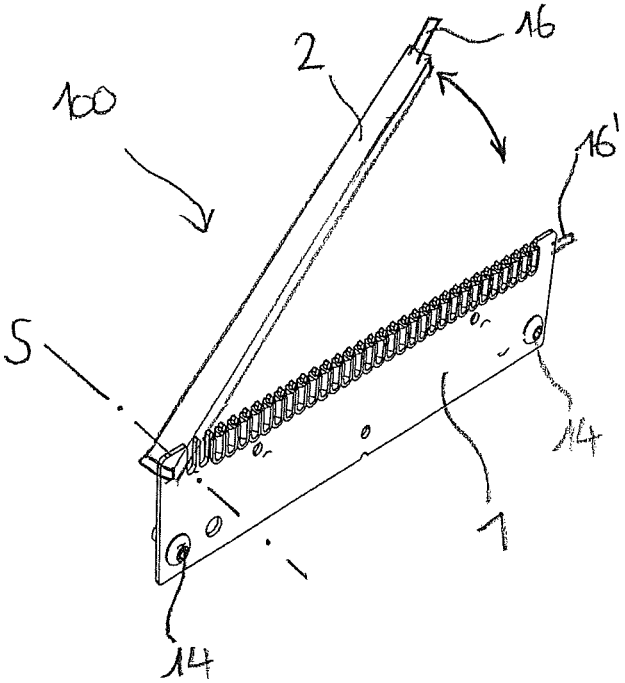

FIG. 8 shows an alternative embodiment of a thread guiding device 100. The cover element 2 is arranged pivotably about a pivot axis S. For the opening and closure, the cover element 2 can be pivoted in the arrow direction and locked with a clasp 16 (represented only schematically) on a projection 16' of the base element 1.

Figure 1:
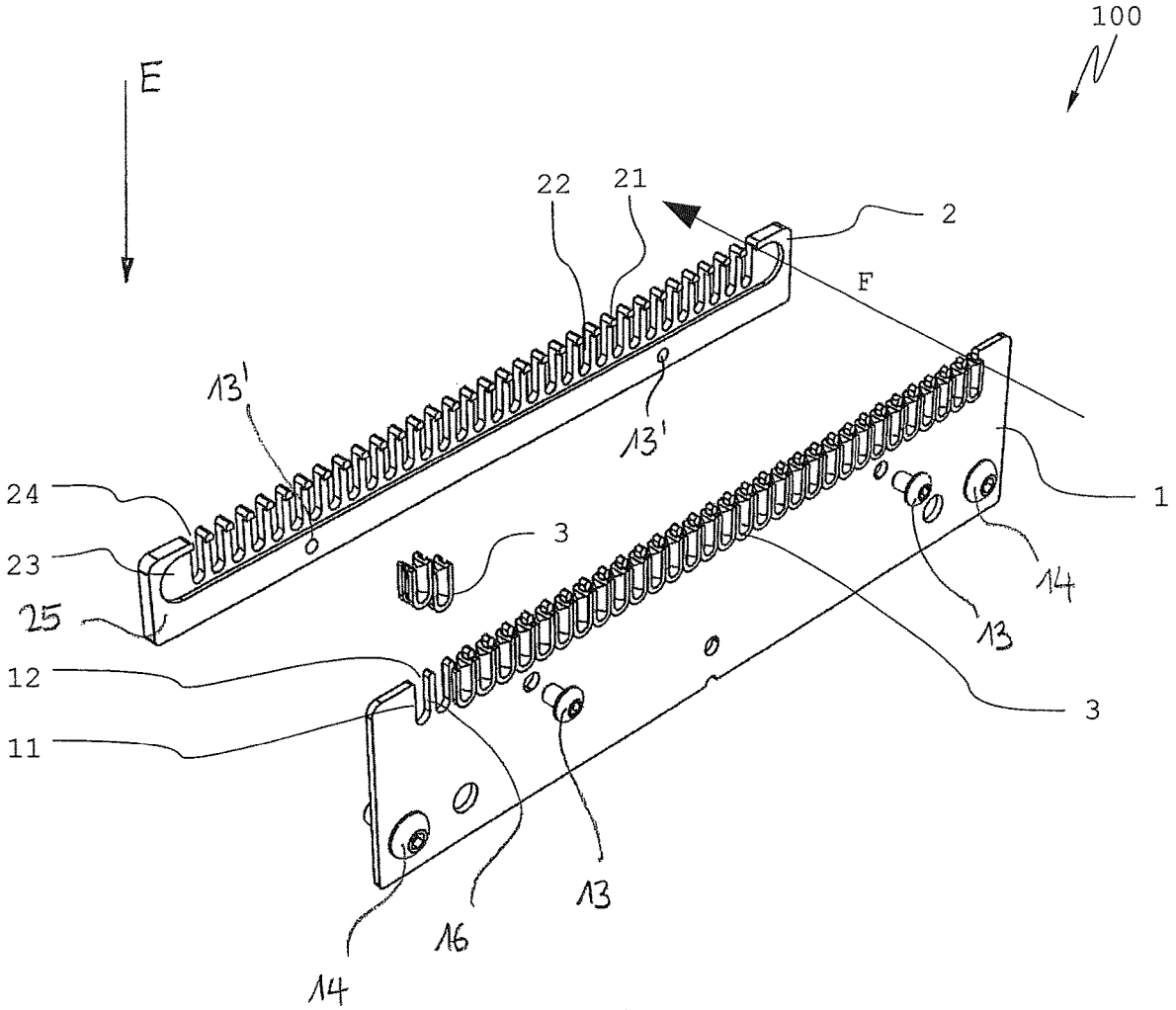
Figure 2:
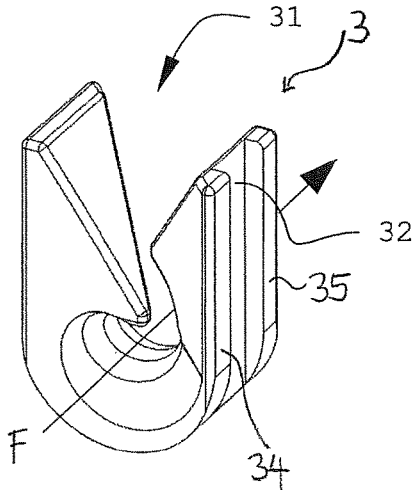
Figure 3:
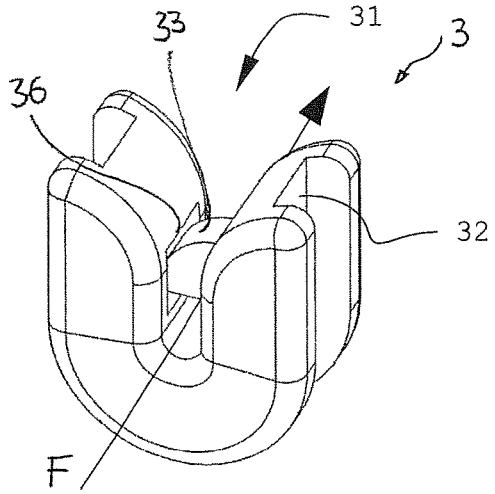
Figure 4:
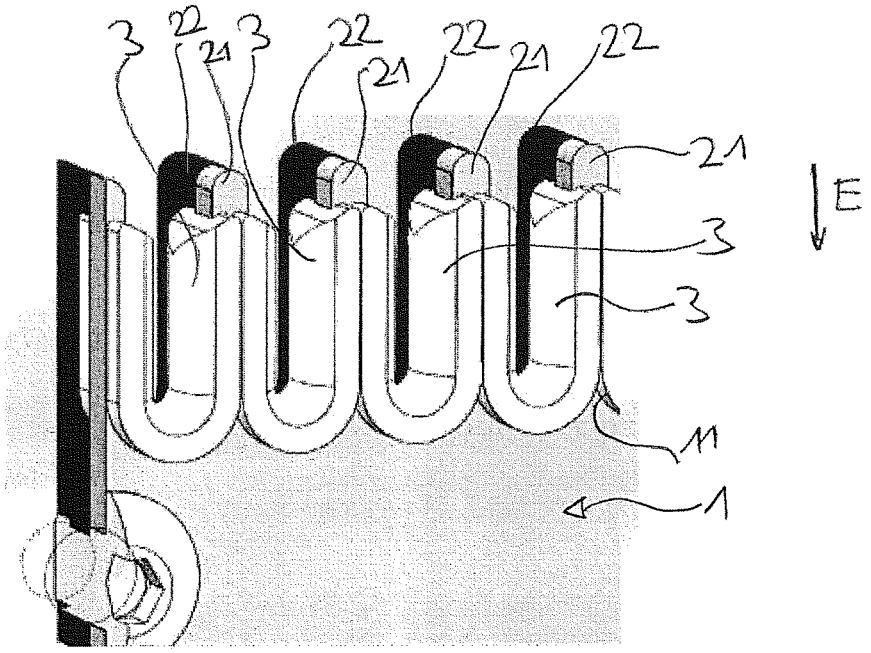
Figure 5:
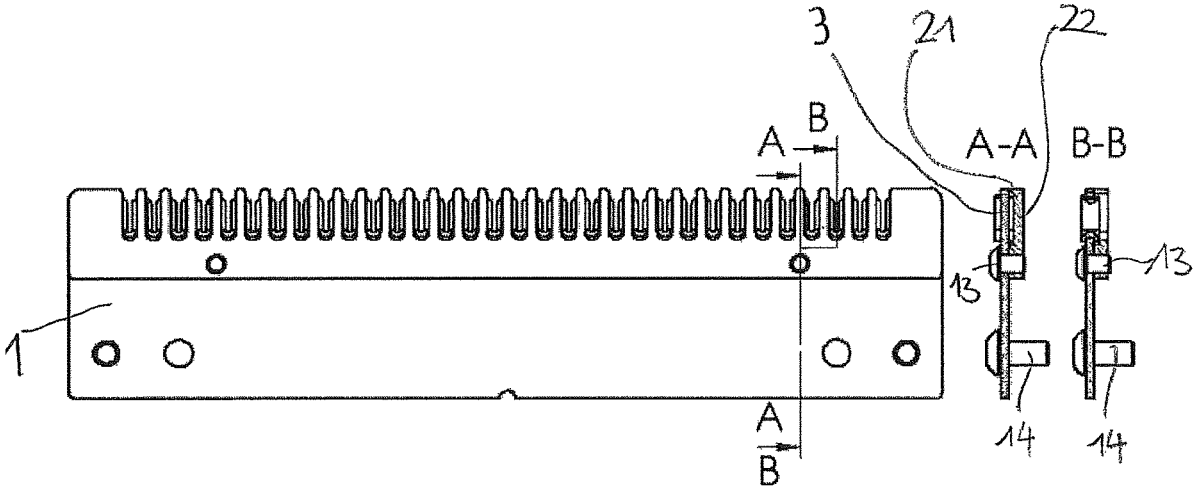
FIG. 5 shows a top view of the base element 1 and (see right-hand side in FIG. 5) sectional representations along the plane A-A and B-B.
Figure 6:
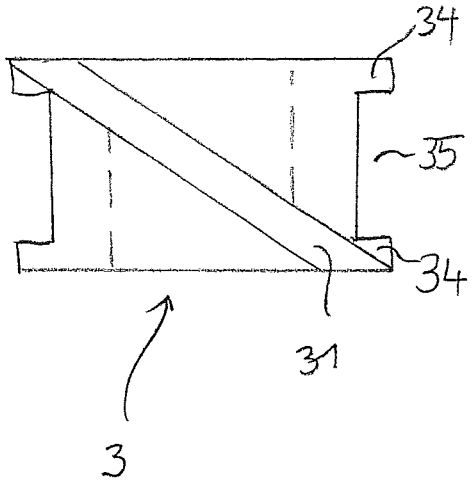
FIGS. 6 and 7 show a schematic top view of the thread guides from FIGS. 2 and 3.
Figure 7:
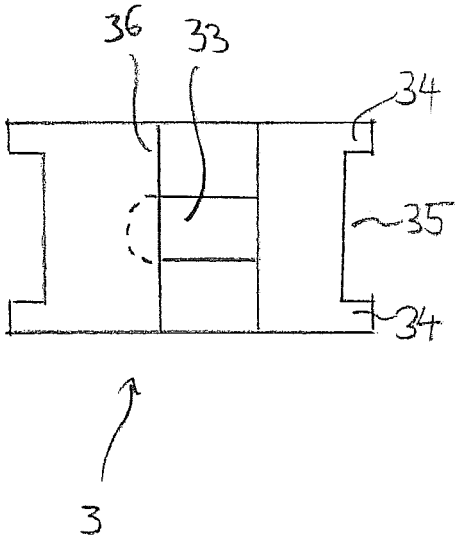
Figure 9:
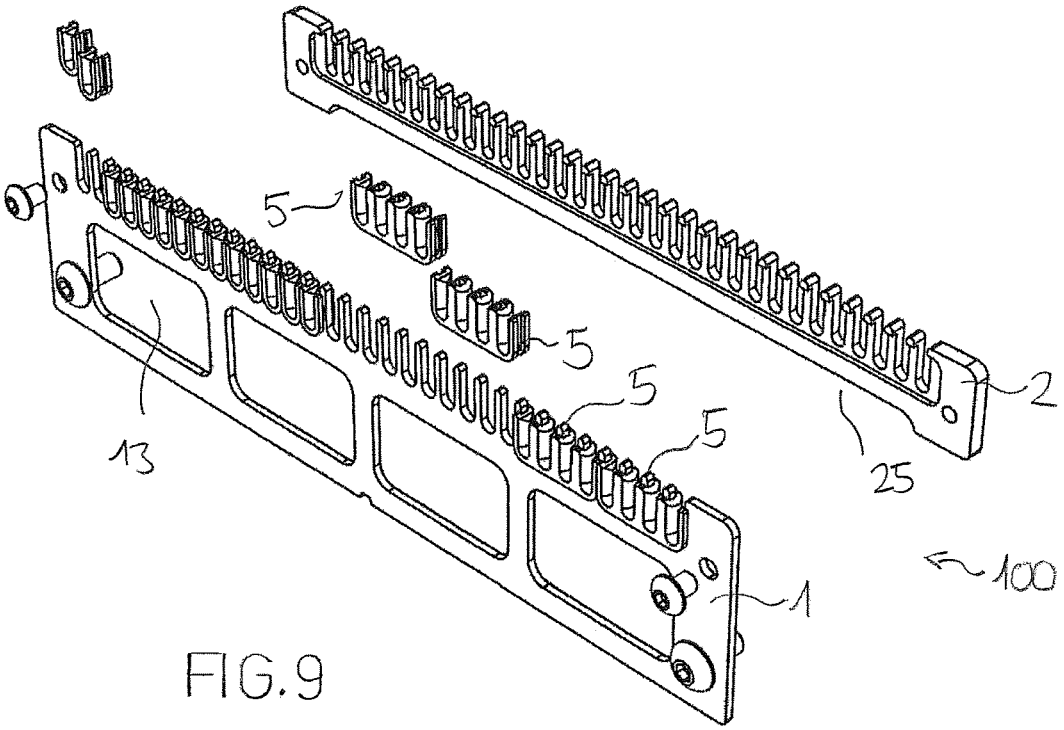

FIG. 9 shows an alternative embodiment of thread guides. The base element 1 and the cover element 2 substantially correspond in terms of their structure to the embodiment according to FIG. 1. Same parts are not denoted or described anew. In contrast to the embodiment according to FIG. 1, the base element 1 has cutouts 13. Correspondingly, the cover element is provided with a recess 25. Once the cover element 2 is mounted, the recess 25 runs at its upper edge substantially congruent with the cutouts 13. The air flows substantially in the direction of running of the thread, transversely to the thread guides, out of the nozzle at front and rear. The outflowing air is diverted at the base element 1 and sets the yarn vibrating. This effect is diminished by the cutouts 13. In contrast to the illustrative embodiment according to FIG. 1, in FIG. 9 a plurality of (specifically four) thread guides are combined into groups 5.

Figure 10A:
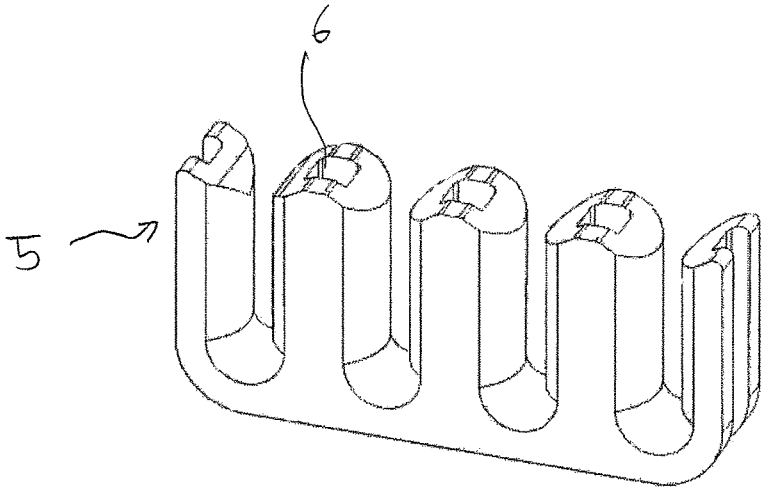
Figure 10B:
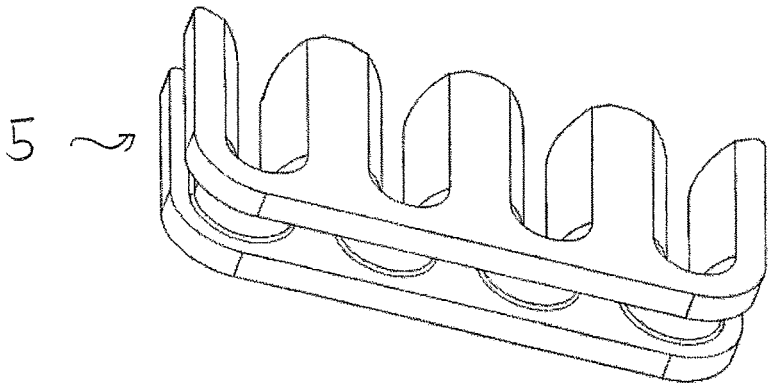

FIGS. 10*a* and 10*b* show perspective representations of the groups 5 of thread guides according to FIG. 9. In the thread guides are provided optional cutouts 6, which can offer an additional guidance effect.

The invention claimed is:

1. A thread guiding device for the guidance of threads, comprising:

a base element, at least one cover element, and at least one thread guide, wherein the at least one thread guide is arrangeable or arranged in a recess of the base element, and the at least one thread guide is held or holdable with the cover element detachably on the base element.

2. The thread guiding device according to claim 1, wherein the thread guide, transversely to an intended direction of movement of the thread, has an opening for a feed-in of the thread.

3. The thread guiding device according to claim 1, wherein the recess in the base element has, transversely to an intended direction of movement of the thread, an opening for insertion of the thread guide.

4. The thread guiding device according to claim 1, wherein the base element has two or more recesses and each recess is assigned a thread guide.

5. The thread guiding device according to claim 1, wherein the cover element has at least one projection for preventing movement of the thread guide counter to a slide-in direction.

6. The thread guiding device according to claim 5, wherein the cover element has at least one web having a free end, and the web is arranged between respectively two adjacent recesses of the base element.

7. The thread guiding device according to claim 6, wherein the at least one projection is configured on the free end of the web.

8. The thread guiding device according to claim 6, wherein the web is of a resilient configuration.

9. The thread guiding device according to claim 5, wherein the cover element, for formation of the at least one projection, has an undercut or a depression.

10. The thread guiding device according to claim 1, wherein the cover element has feed-throughs.

11. The thread guiding device according to claim 10, wherein the cover element is configured such that the thread guides are protected against shock.

12. The thread guiding device according to claim 10, wherein the cover element and the base element have, at least in relation to the recesses and feed-throughs, a substantially similar contour.

13. The thread guiding device according to claim 1, wherein the cover element has a common projection for two thread guides.

14. The thread guiding device according to claim 1, wherein the cover element is screwed or screwable to the base element.

15. The thread guiding device according to claim 1, wherein the cover element is articulately connected to the base element for the fixing of the cover element.

16. The thread guiding device according to claim 15, wherein a quick-release fastener is provided.

17. The thread guiding device according to claim 1, wherein the thread guide has a cross section for engagement in the base element, which cross section is configured such that the thread guide encompasses, or can encompass, the base element at least partially on both sides.

18. The thread guiding device according to claim 1, wherein the thread guide is produced from a ceramic material.

19. The thread guiding device according to claim 1, wherein a plurality of thread guides are combined into groups.

20. The thread guiding device according to claim 1, wherein the base element is provided with venting cutouts.

* * * * *